United States Patent [19]

Christine et al.

[11] Patent Number: 4,516,691

[45] Date of Patent: May 14, 1985

[54] PIERCE TURN TAP

[75] Inventors: William C. Christine, Catasauqua, Pa.; Charles H. Trillich, Long Valley, N.J.

[73] Assignee: Trinity Foundation, Nazareth, Pa.

[21] Appl. No.: 342,660

[22] Filed: Jan. 25, 1982

[51] Int. Cl.[3] ..... B67B 7/24

[52] U.S. Cl. ..... 222/83.5; 222/522

[58] Field of Search ..... 222/83, 83.5, 80, 81, 222/89, 90, 519, 520, 522, 525, 538, 567, 569, 183, 518, 559, 524, 105, 107, 153, 143; 229/DIG. 14; 220/465

[56] References Cited

U.S. PATENT DOCUMENTS

| | | | |
|---|---|---|---|
| 594,258 | 11/1897 | Lines | 222/524 |
| 2,698,113 | 12/1954 | Linton | 222/83 |
| 3,062,411 | 11/1962 | Miles | 222/143 |
| 3,223,117 | 12/1965 | Curie et al. | 222/183 |
| 4,214,675 | 7/1980 | Schmit | 222/83 |
| 4,322,018 | 3/1982 | Rutter | 222/83 |

FOREIGN PATENT DOCUMENTS

| | | | |
|---|---|---|---|
| WO81/02418 | 7/1981 | PCT Int'l Appl. . | |
| 621985 | 3/1981 | Switzerland | 222/83 |
| 2082152 | 3/1982 | United Kingdom | 222/83 |

*Primary Examiner*—Joseph J. Rolla
*Assistant Examiner*—Kenneth Noland
*Attorney, Agent, or Firm*—Sherman Levy

[57] ABSTRACT

A pierce turn tap is provided that consists of two parts, and wherein there is provided integral molded seals, and wherein the pierce turn tap is adapted to be mounted on plastic pouches. The pierce turn tap has an integral seat and an integral flange for sealing directly to a plastic pouch. The tap is especially suitable for holding in an automatic attachment system for the purpose of sealing directly on a plastic pouch. External concentric body flanges are provided to permit alignment and automatic attachment. A locking device is provided for receiving a tab of a box, such as a cardboard box, whereby the body of the tap is locked and cannot rotate when the tap handle is rotated in use. The pierce turn tap includes inner and outer members, the inner member having a piercing device thereon, and wherein the members have openings that can selectively register with each other to permit material from the pouch to be dispensed.

7 Claims, 10 Drawing Figures

PIERCE TURN TAP

FIELD OF THE INVENTION

The present invention is directed to a pierce turn tap which is adapted to be used for selectively puncturing or severing an opening in a pouch so that material in the pouch can be selectively dispensed from the pouch in a desired efficient manner. The pierce turn tap is adapted to be automatically attached in a form/fill/seal pouch machine, and the tap is adapted to be molded at low cost and attached at high speed.

Further, the present invention consists of a turn tap with integral seat (seal) means, and there is provided a plastic turn tap with an integral flange for sealing directly to the plastic pouch. The plastic turn tap has an external cylindrical configuration suitable for holding in an automatic attachment system for the purpose of sealing directly on a plastic pouch. The tap can be attached directly to a plastic pouch and formed with external concentric body flanges to permit alignment and automatic attachment. There is further provided a locking means to receive a tab of a cardboard box, whereby the body of the tap is locked and cannot rotate when the tap is rotated in use.

DESCRIPTION OF THE PRIOR ART

Heretofore various types of dispensers have been provided, as for example, attention is directed to prior U.S. Pat. Nos. 3,894,381, 4,246,062, 4,214,675, 4,055,032, 3,343,724, 3,792,799, and 3,474,933. However, neither these prior patents nor any other known to applicant achieve the advantages of the present invention.

BACKGROUND AND SUMMARY OF THE INVENTION

The present invention relates to new and improved pierce turn tap which has a means for maintaining the piercing member in a pre-piercing position until a manual axial push or force is applied to the piercing membrane whereby a pouch or film package can be effectively and efficiently cut open so that the fluidic contents of the pouch will pass through the tap in the desired quantity and the piercing member will remain in its post-piercing position. The piercing member can be rotated so that the fluidic material can be dispensed from the pouch in the desired quantity and then the piercing member can be turned or rotated so as to prevent further flow of material from the pouch.

It is an object of the present invention to provide a pierce turn tap that is adapted to be automatically attached in a form/fill/seal pouch machine, and wherein the tap body is cylindrical in formation whereby the sleeve of the attachment system can come down around the tap and apply pressure to the attachment flange in the desired manner.

It is a still further object of the present invention to provide a pierce turn tap which is adapted to be conveniently molded in plastic material whereby low cost dispensing tap is provided, and wherein the tap comprises an inner member having a piercer thereon and wherein the inner member is fitted within an outer body member. The inner member is restrained in a parked position so that the piercer cannot pierce the film accidentally. However, the piercer can be readily actuated easily by pushing the inner member forward through the film, and by rotating the inner member 240°, the piercer cuts away the film to provide a large, unrestricted opening for the flow of material thereto.

A still further object of the present invention is to provide a two piece turn tap that has an integral seal ring molded into one of the two parts so as to create or provide a seal between the parts so as to prevent leakage, and wherein leakage is prevented while still having minimum friction between the two parts.

A still further object of the present invention is to provide a pierce turn tap that consists of two pieces so that it is low in cost to manufacture, and wherein there is provided a unique pierce feature, and there is also provided an integral molded seat means.

A still further object of the present invention is to provide a pierce turn tap that is adapted to be molded at low cost and attached at high speed and hence at low cost, and wherein the present invention permits high flow because the pouch is not only pierced, but cut out leaving a large opening flap of material that cannot pass through the valve.

It is a still further object of the present invention to provide a pierce turn tap that is ruggedly constructed and relatively simple to manufacture and install and efficient in use.

It is a still further object of the present invention to provide a pierce turn tap which is made of two parts, and which includes integrally molded seals for mounting on plastic pouches, or made of plastic parts.

Other objects of the invention are to provide a pierce turn tap which is relatively inexpensive and wherein there is provided a novel and improved construction. The above and other features and objects of the invention will be apparent to those skilled in the art to which this invention pertains from the following detailed description and the drawings.

DESCRIPTION OF THE PREFERRED EMBODIMENT

Figure 1:
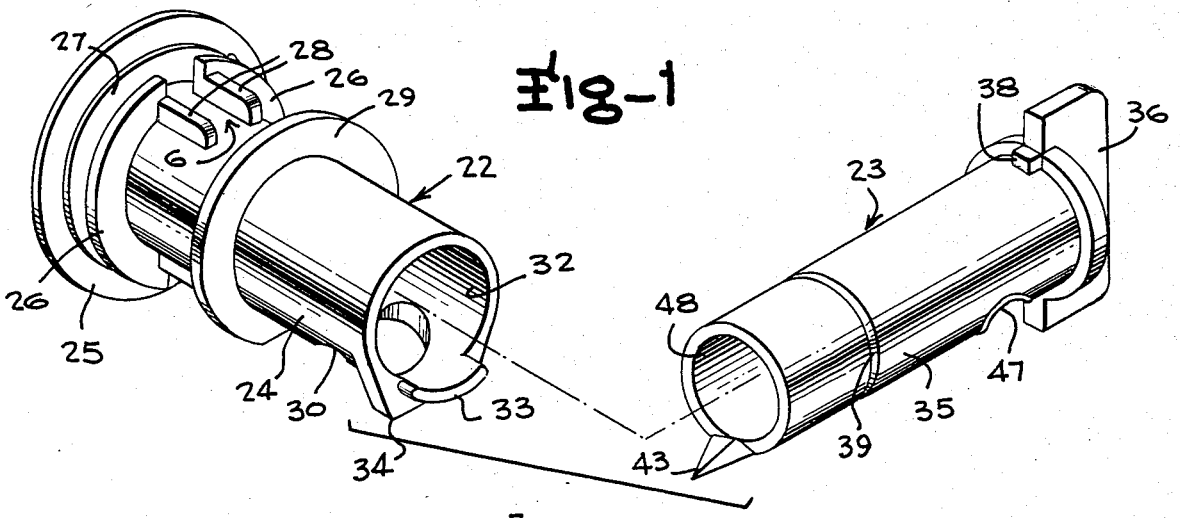
FIG. 1 is an exploded perspective view of the pierce turn tap of the present invention and with the parts separated for clarity of illustration.
Figure 10:
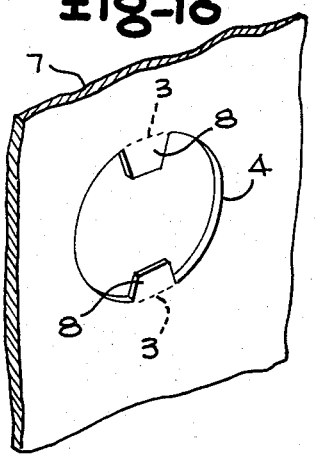
FIG. 10 is a fragmentary perspective view of the knocked out hole with the tabs remaining on the wall of the cardboard box 11.

Referring in detail to the drawings, the numeral 20 indicates the pierce turn tap of the present invention which is adapted to be attached to a pouch or package 21 containing fluidic material to be dispensed. As shown in the drawings, the tap 20 includes or consists of two pieces, namely an outer body member 22, and an inner piercing member 23. The outer body member 22 includes a cylindrical sleeve 24, FIG. 1; and a flange 25 is arranged on the inner end of the sleeve 24. The flange 25 is adapted to be secured to the outer surface of the pouch 21 in a suitable manner as for example by means of ultrasonic welding, adhesives, other joining techniques or the like. Curved rim portions 26 are provided on the outer surface of the sleeve 24, and the rim portions 26 are spaced from flange 25 whereby there is defined a space 27 for receiving a portion of a cardboard box, container or the like, therein, as for example when the unit is being used in a bag and box construction such as that shown in prior patent application Ser. No. 136,672 of William C. Christine, filed Apr. 2, 1980. Reinforcements 28 are provided on the outer surface of the sleeve 24 as shown in the drawing. As shown in broken lines or dotted lines in FIG. 2, the numeral 7 indicates a portion of a cardboard box which has tabs 8 that fit into space 6 defined between the projections 28, and this construction provides a locking means because the tabs 8 of the cardbord box 7 are arranged so that the body of the tap is locked and cannot rotate when the tap is rotated in use. Thus, as shown in FIG. 10, there is provided a knocked out hole 4 with the tabs 8 remaining and the tabs 8 are adapted to be folded up along the dotted lines 3 for insertion of the tap and then folded down to lock between portions 28. There is further provided an annular flange portion 29 which provides a convenient hand grip to facilitate the manual operation or manipulation of of the tap. The sleeve 24 further has a discharge opening 30 therein which is adapted to have fluidic material 31 selectively dispensed or discharged therethrough, FIG. 5, when the parts are properly positioned or arranged relative to each other. The outer end of sleeve 24 is open as in 32, and arranged on the outer end portion of the sleeve 24 is a curved stop element 33 for a purpose to be later described. A shoulder 34 is provided on the sleeve 24 adjacent to the outer end.

The inner piercing member 23 includes a cylindrical element 35 that has a handle 36 on its outer end, and indicia in the form of an arrow 37 is provided on a convenient outer portion of the handle 36. There is also provided on the inner piercing member 32 a stop piece 38 which is adapted to selectively co-act with the stop element 33 as later described in this application. Certain aspects of the attachment of the tap to the pouch are shown and described in prior patent application, Ser. No. 124,971 of William C. Christine.

Figure 7:
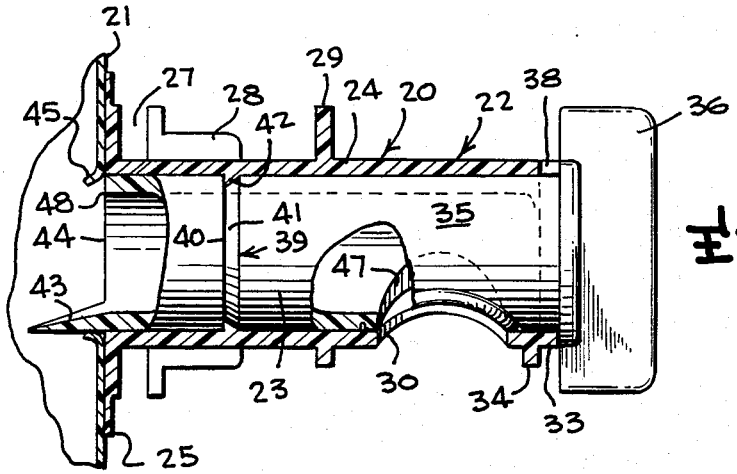
FIG. 7 is a sectional view taken on the line 7—7 of FIG. 6.

There is provided in the outer surface of the cylindrical section 35 of the piercer 23 an annular or circular groove 39 which has a unique configuration so that it includes a flat wall section 40 as well as an inclined wall section or surface 41, FIG. 7. An inwardly disposed rib or keeper 42 is formed on the inner surface of the sleeve 24 so that the keeper 42 can selectively engage the groove 39 in a locking relationship. The cylindrical section 35 of the piercer 23 is adapted to be made of a relatively soft plastic material.

Figure 4:
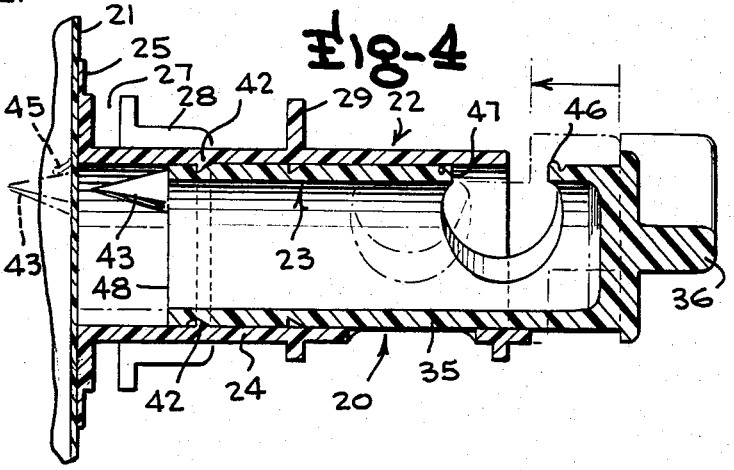
FIG. 4 is a sectional view taken along line 4—4 of FIG. 3.
Figure 5:
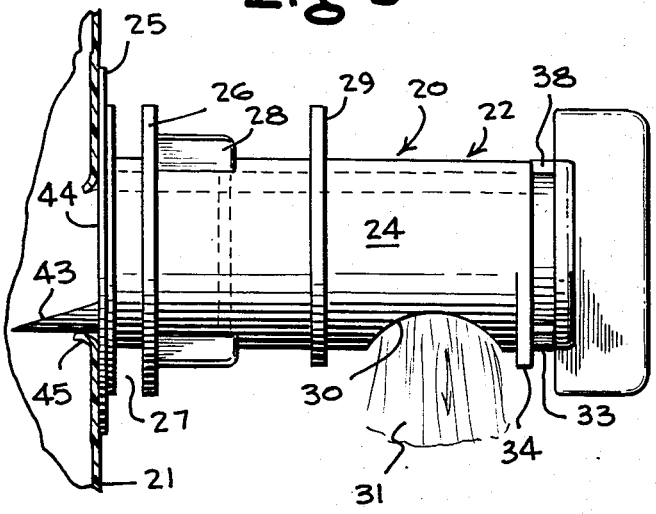
FIG. 5 is a side elevational view showing the tap in open position.

There is provided on the inner end of the element 23 a pointed, sharp piercer 43 which is adapted to selectively form an opening 44 in the pouch 21, and by properly moving the piercer inward and rotating the same, a flap portion 45 will be provided on the pouch, FIG. 5. There is provided on the inner piercing member 23 a soft lip 46, FIG. 4. The inner piercing member 23 has an opening 47 therein that is mounted for movement into and out of registry with the opening 30 in the sleeve 24. The inner end of the piercing member 23 is opened as at 48.

From the foregoing, it will be seen that there has been provided a pierce turn tap, and in use with the parts arranged as shown in the drawings, the tap 20 of the present invention is adapted to be suitably secured to a pouch 21 in any suitable manner, as for example the flange 25 can be ultrasonically bonded or adhesively secured or otherwise joined to the outer surface of the pouch 21. The tap can be used in conjunction with a bag-in-box construction or it may be used in other types of operations. The tap 20 further includes the inner piercing member 23 which is telescopically mounted within the outer member 22. Initially, the piercing member 23 is in the outer position, and when it is desired to dispense the quantity of the fluidic material from the pouch 21, it is only necessary to manually push the piercing member 23 inwardly and rotate the same whereby the sharp piercing element 43 will cut an opening 44 in the pouch 21 so as to leave a flap portion 45 attached to the pouch. By properly aligning the opening 47 with the opening 30, the fluidic material can flow through the opening 44, then through the hollow interior of the member 23, and out through the registering openings 30 and 47 so that, for example, as shown in FIG. 4, the fluidic material 31 can be disposed into a receptacle or the like. After a desired quantity of fluidic material has been dispensed, the member 23 can be selectively rotated to move the opening 47 out of registry with the opening 30 so that no further dispensing or discharge of material will occur.

It will be noted that the outer member 22 is provided with the inwardly disposed annular keeper or rib 42 which selectively engages the annular slot or groove 39 so as to retain the parts in piercing position as shown in FIG. 4.

The parts can be made of any suitable material and in different shapes or sizes as desired or required.

The tap of the present invention is adapted to be used with pouches containing various types of material such as wine, juice, oil, water, or other materials exhibiting fluidic characteristics, and the like. Some of the important aspects or features of the present invention are as follows: There is provided a tap that is adapted to be automatically attached in a form/fill/seal pouch machine. The tap body is cylindrical so that the sleeve of the attachment system can come down around the tap and apply pressure to the attachment flange.

There is provided a two piece tap which is molded of plastic material so that there is produced a low cost dispensing tap.

Further, the tap consists of an inner member 23 with a piercer 43, the inner member being fitted within the body member 22 and wherein the inner member is restrained in a parked position by the keeper 42 that is disposed inwardly on the sleeve 24. There is provided on the outer sufrace of the cylindrical section 35 the annular groove 39 which has a unique configuration so that it includes the flat surface or shoulder 40 as well as the inclined surface 41, and as shown in FIG. 7, the keeper 42 when engaging the groove 39 will maintain the parts in an open locked position. Thus, it will be seen that the tap consists of the inner member with the piercer, that is fitted within the body member, and wherein the inner member is restrained in a parked position so that the piercer 43 cannot pierce the film 21 accidentally.

However, the piercer can be actuated easily by pushing the inner member 23 forward so that the piercing element 43 pierces the film 21 to provide the opening 44 and leave the flap portion 45 partially connected to the remaining portion of the pouch. By rotating the member 23, a certain distance such as 240°, by means of a handle 36, the piercing element 43 cuts away the film to present or provide a large unrestricted opening 44.

Further, the pierce turn tap of the present invention is of a two piece construction with an integral seal ring molded into one of the two parts so that there is created a seal between the parts and this prevents leakage.

As is known, in the past, two piece one-quarter turn cocks or valves have been made for many years and sealed face to face by tapered fits. For example, many years ago valves with cylindrical parts were provided using an "O" ring seal around the circumference of the port.

The problem is to prevent leakage while still having minimum friction between the two parts. Friction makes the tap difficult to turn and also difficult to mount properly on the pouch or to fasten on to the box. Thus, if the friction is too great, the body of the tap tends to want to rotate with the inner portion and tends to tear the tap off the pouch and tear it out of the box on which it is mounted. The present invention solves this problem by creating a tap with a slip fit between the two parts for ease of operation, and there is provided a raised seal area around the circumference of the port, and this eliminates the leakage and creates only minimum friction.

With the present invention there are only two pieces utilized and this is to be compared with other kinds of devices which use more than two pieces for such taps. This is important because cost is directly related to the number of pieces. Some of the important features or elements of the present invention are that the pierce turn tap consists of only two pieces so that it can be made at low cost, the pierce feature, and the integral molded seat means.

Further, the pierce turn tap of the present invention is adapted to be molded at low cost and attached at high speed, and hence at low cost. The pierce turn tap is capable of high flow because the pouch is not only pierced, but cut out leaving a large opening in the flap of material that cannot pass through the valve.

It will be seen that with the present invention there has been provided a cylindrical tap and film piercer which functions as a valve and wherein the inner and outer member interfit and telescope so that the package film can be severed. The keeper 42 will either selectively engage the groove 39 to retain the parts in a locked position, or the keeper 42 can dig into the soft plastic member 35 in a different position to temporarily hold the parts in the outer position until the film is to be pierced. Thus, there is provided means for maintaining the piercing member in a pre-piercing position until an axial push or force is applied to the piercing member whereby the element 43, upon being turned, cuts an arcuate path in the film so that the contents can pass through the valve section and be selectively discharged through the registering openings 30 and 47. When no further material is to be dispensed, the handle 36 can be manually gripped so that the piercing member can be rotated to move the opening 37 out of registry or alignment with the opening 30 so that no further material will be dispensed. The stop element 38 co-acts with the arcuate stop element 33 to limit rotation of the piercing element 23 within the outer body member 22.

With the present invention there is provided a two piece pierce turn tap which can be arranged in either a pre-piercing state, or wherein the parts can be arranged in a post-piercing state or position. Further, when the device is in the ultimate post-piercing position, it is unable to return to a pre-piercing position due to the inter-engagement of the keeper 42 and groove 39. However, even though the parts are in a post-piercing position, the inner member 23 can rotate about a 240° circumference from a closed to an open position, and vice versa so that fluid contents from the film package or pouch can be dispensed.

Thus, the tap is constructed so that the parts will be restrained in a "parked" position until it is desired that the piercer is needed and it is desired to pierce the film package, and yet accidental piercing will be prevented, although the device can be easily actuated by pushing the inner member forward so that the element 43 cuts through the film. After the piercing element has been pushed forward and rotated approximately 240° C., the piercer cuts away the film to present a generally large unrestricted opening therein so that the fluidic contents can be dispensed. Then, the tap is restrained from returning from its post-piercing position to its pre-piercing position.

Further, with the present invention there is provided a two piece tap with an integral seal ring molded into one of the two parts creating a seal between the parts so as to prevent leakage and concurrently therewith performing the restraining means which precludes the return of the tap from the post-piercing position to the pre-piercing position or "parked" position.

The handle 36 provides a convenient grasping element to permit convenient inward movement of the piercing element 23 and also the handle 36 facilitates rotation of the piercing element 23. The handle 36 can function in conjunction with the flange 29 to provide a convenient grip. When the tap is used in a bag-in-box type of operation, a portion of a cardboard box can be conveniently received in the space 27 between the flanges 26 and 25. The portions 28 provide reinforcement for the tap, especially in the vicinity of the area where the keeper or lug 42 projects inwardly.

Figure 2:
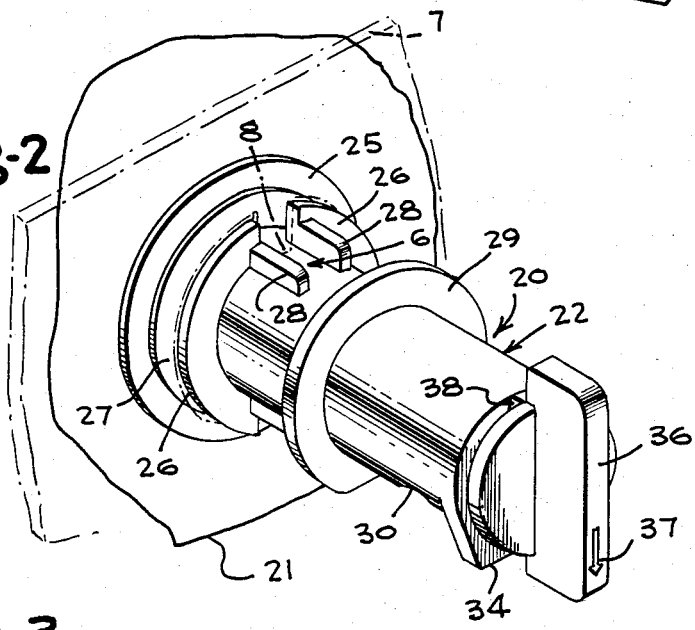
FIG. 2 is a perspective view showing the parts assembled.

As shown in FIG. 2, there is provided an arrow 37 on the handle 36 and this indicia or arrow 37 gives an indication to the user when the parts are in a position such as to permit fluidic contents to be discharged through the outlet spout consisting of the openings 30 and 47. Thus, the parts 28 provide increased strength for the tap. The lug or keeper 42 can selectively engage thr groove 39 to prevent accidentally movement of the parts from their desired position. Otherwise, the lug 42 can frictionally engage the soft outer surface of the portion 35 so that friction is provided to retain the piercer from improperly extending the piercer into the film pouch until the desired time. A slip fit relationship is provided between the outer surface of the member 23 and the inner surface of the member 22, as shown in FIG. 7, the groove 39 has a triangular shape in cross section so that it includes the surfaces 40 and 41. This construction provides a safe locking arrangement when the groove 39 is engaged by the keeper or lug 42.

Figure 6:
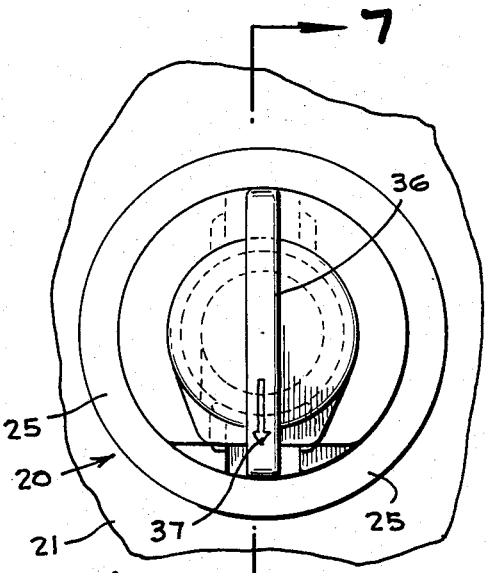
FIG. 6 is an end elevational view showing the tap in open position.
Figure 8:
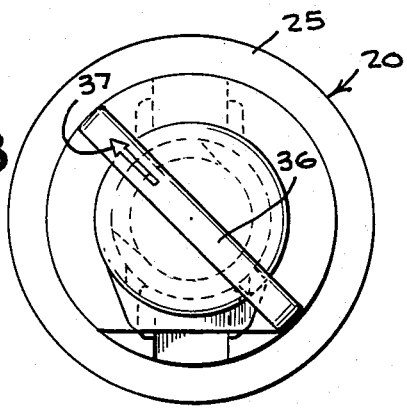
FIGS. 8 and 9 are end elevational views showing the tap in closed position.
Figure 9:
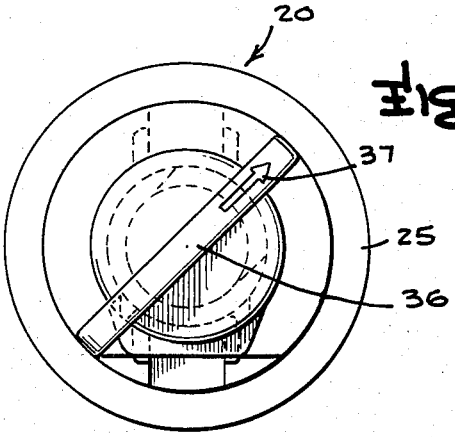

As shown in FIGS. 8 and 9, the handle 36 can be used for rotating the inner member either left or right through approximately 240° to achieve the desired results. Even though the inner member can rotate within the outer member, there is a generally tight fit between the surfaces of these members, and this in conjunction with the raised seal construction assures that there will be no fluid passage from the pouch until the handle 36 turns the piercer through an arc and thus, no fluid can be dispensed until the arrow 37 points downwardly as shown in FIG. 6. Thus, by turning the handle 36 so that the arrow 37 moves to either a position shown in FIG. 8 or FIG. 9, the device is in closed position so that no fluidic material will be dispensed therefrom. When it is desired to dispense a quantity of material from the pouch, it it only necessary to manually rotate the handle 36 either left or right from the position shown in FIGS. 8 and 9 to a position such as that shown in FIG. 6 whereby the opening 47 will be brought into alignment or registry with the opening 30 so that material can flow down through the discharge spout created by the openings in registry with each other. The stop element 38 co-acts with the outer edges of the stop piece 33 to limit travel or rotation of the member 23 relative to the member 22.

Figure 3:
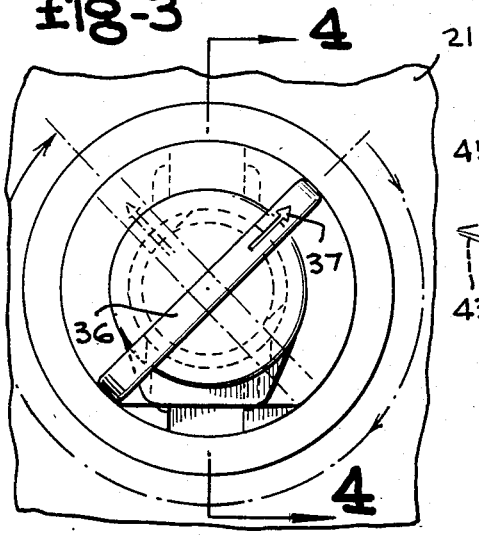
FIG. 3 is a front elevational view showing the device in piercing position.

FIG. 6 illustrates the device in open position. FIG. 8 illustrates the device rotated approximately 135° to the right to closed position from opened position. FIG. 9 illustrates the device rotated to the left approximately 135° to closed position from opened. FIG. 3 indicates the direction of rotation.

FIG. 5 shows the tap in locked open position with the openings 30 and 47 in alignment or registry. FIG. 4 shows the device in parked position. To pierce, with the parts arranged as shown in FIG. 4, it is only necessary to push down on the wedge and then rotate 240° from stop to stop, such as from the stop 38 to either edge of the stop 33. The pouch is indicated by the numeral 21, and as previously stated, the pouch may have any type of material to be dispensed of a fluidic nature.

Initially, it will be understood that before the pouch is pierced, the parts are in an outer position such as that shown in FIG. 4, and the interrelationship and interengagement of the parts prevents accidental piercing of the film. When it is desired to dispense material, the sequence of operations previously described is carried out so that the film is pierced an the fluidic material can be dispensed. After the pouch has been severed, the inner member can be rotated to either an opened or closed position to selectively permit material to be discharged into a waiting receptacle or the like.

It will be seen that with the present invention there is provided a pierce turn tap that includes an integral seat (seal) means and wherein the two piece tap is of economical construction. The tap can be conveniently made of plastic and the plastic turn tap has an integral flange for sealing directly to a plastic pouch. The plastic turn tap has external cylindrical configuration suitable for holding in an automatic attachment system for the purpose of sealing directly on a plastic pouch. The two piece turn tap has molded integral seals, and is adapted to be molded of heat sealable resins and formed with an integral flange for the purpose of attaching directly to a plastic pouch and the tap is adapted to be formed with external concentric body flanges to permit alignment and automatic attachment.

Further, the plastic tap has the lock means to receive tabs 8 of the cardboard box 7, and the tabs 8 are adapted to be received in the space 6 between projections 28 so that the body of the tap is locked and cannot rotate when the tap is rotated in use. The space 27 provides a space for receiving a portion of the cardboard box 7. Thus, there is provided a pierce turn tap consisting of two parts with integral molded seals for mounting on a plastic pouch, and wherein the tap is made of plastic parts. With the present invention integrally molded seals are utilized, and automatic feeding is efficiently carried out. An important aspect of the present invention is the sealing means in conjunction with other features such as the tap made of two parts, the construction that permits use with an automatic attachment system for facilitating the sealing of the tap directly on a plastic pouch, the locking feature, and the economical construction that is provided by means of the two-part construction as well as the efficiency of operation that is provided by means of the tap.

With further reference to the further invention, the lip 46 is of generally soft material and squeezes down on the edge 2 at the proper time, and this construction assures there will be no leakage of fluid between the portions 46 and 2.

As shown in FIG. 10, the wall of the cardboard box has the knocked out hole 4 with the tabs 8 remaining. These tabs 8 are adapted to be folded up for insertion of the tap and then folded down to be locked between the portions 28. FIG. 10 illustrates the configuration of the tabs in the drawings.

While several embodiments of the present invention have been illustrated herein in particular detail, it will be understood that variations and modifications may be effected without departing from the spirit and scope of the novel concepts of this invention.

What is claimed:

1. A two part tap with integral molded seals for mounting and sealing directly on a plastic pouch and wherein the tap is made of plastic parts, said tap including a piercer member, a body member including a sleeve disposed in telescopic relation to the piercer member, said body member having flange securably on to a segment of a film pouch, and a piercing means extending from the cylindrical piercing member, circular ridge on the inner surface of the cylindrical sleeve, there being a circular groove on the outer surface of the piercer member adapted for engagement with the circular ridge, the ridge and groove being engagable selectively when the piercing means extends beyond the plane of the flange element, and aperture means in the piercer member for selectively mating with aperture means of said sleeve when the piercing means extend beyond the flange element, the pouch adapted to hold various fluidic materials such as wine, juice, oil, water, and the like, wherein the pierce turn tap can be automatically fed and attached in a form/fill/seal pouch machine, the pierce turn tap includes means for restraining the piercer member in a parked position so that the piercing means cannot pierce the film of the pouch accidentally, and wherein the piercer member can be readily actuated by pushing the piercer member forward through the film so that by rotating the piercer member, a portion of the film of the pouch will be cut away to provide a large unrestricted opening, the pierce turn tap being made of two pieces and an integral seal ring molded into one of the two pieces creating a seal between the parts so as to prevent leakage, wherein the pierce turn tap has a slip fit between the piercer member and the body member for ease of operation, there being a raised seal area around the circumference of an aperture to eliminate leakage and create only minimal friction.

2. The structure as defined in claim 1 wherein the pierce turn tap is adapted to be molded at low cost and automatically fed and attached at high speed and hence low cost, and wherein the pierce turn tap is capable of high flow because the pouch is not only pierced but cut to leave a large opening flap of material that cannot pass through the tap.

3. The structure as defined in claim 2 and further including stop means for limiting rotation of the piercing member in said sleeve.

4. A two part tap with integral molded seals for mounting and sealing directly on a plastic pouch and wherein the tap is made of plastic parts, said tap including a piercer member, a body member including a sleeve disposed in telescopic relation to the piercer member, said body member having a flange securably on to a segment of a film pouch, a piercing means extending from said cylindrical piercing member, and further including a circular ridge on the inner surface of the cylindrical sleeve, a circular groove on the outer surface of the piercer member adapted for engagement with the circular ridge, the ridge and groove being engagable selectively when the piercing means extends beyond the plane of the flange element, and aperture means in the piercer member for selectively mating with aperture means of said sleeve when the piercing means extends beyond the flange element, and wherein the plastic pouch is adapted to hold various fluidic materials such as wine, juice, oil, water and the like, and wherein said pierce turn tap can be automatically fed and attached in a form/fill/seal pouch machine and wherein the pierce turn tap includes means for restraining the piercer member in a parked position so that the piercing means cannot pierce the film of the pouch accidentally, and wherein the piercer member can be readily actuated by pushing the piercer member forward through the film so that by rotating the piercer member, a portion of the film of the pouch will be cut away to provide a large unrestricted opening therein, and wherein the pierce turn tap is made of two pieces with an integral seal ring molded into one of the two pieces thereby creating a seal between the parts so as to prevent leakage, and wherein the pierce turn tap has a slip fit between the piercer member and the body member for ease of operation, therebeing a raised seal area around the circumference of an aperture to eliminate leakage and create only minimal friction.

5. The structure as defined in claim 4 wherein the pierce turn tap is adapted to be molded at low cost and automatically fed and attached at high speed and hence low cost, and wherein the pierce turn tap is capable of high flow because the pouch is not only pierced but cut so as to leave a large opening flap of material that cannot pass through the tap.

6. The structure as defined in claim 5 and further including stop means for limiting rotation of the piercing member in the sleeve.

7. A two piece plastic turn tap consisting of two parts, one of said parts comprising a body member including a sleeve having a flange for attachment to a pouch, a rim on said sleeve spaced from said flange, said flange and rim co-acting to provide a space for receiving a portion of a box container, and wherein there is provided a locking means that includes members extending transversely from the rim to receive tabs of a box container to prevent rotation of the tap relative to the box container, an inner piercer member including a sharp pointed portion, said piercer member being made of relatively soft material, a flange portion mounted on the sleeve providing a convenient hand grip to facilitate manual manipulation of the tap, there being an aperture in said sleeve, a keeper disposed inwardly on the sleeve, there being an annular groove in said piercer member for selective engagement by said keeper, said piercer member having an aperture for selective registry with the aperture in the sleeve, a handle on said piercer member, and inter-engaging stop elements on said piercer element and sleeve for selectively limiting movement of the piercer member.

* * * * *